US005812912A

United States Patent [19]

Hiroi et al.

[11] Patent Number: 5,812,912

[45] Date of Patent: Sep. 22, 1998

[54] AUTOMATIC ORIGINAL SUPPLYING APPARATUS HAVING COUNT MODE

[75] Inventors: Masakazu Hiroi, Kawasaki; Noriyoshi Ueda, Yokohama; Tomohito Nakagawa, Tokyo, all of Japan

[73] Assignee: Canon Kabushiki Kaisha, Toyko, Japan

[21] Appl. No.: 935,188

[22] Filed: Sep. 22, 1997

Related U.S. Application Data

[63] Continuation of Ser. No. 535,842, Sep. 28, 1995, abandoned.

[30] Foreign Application Priority Data

Sep. 29, 1994 [JP] Japan ..... 6-261321

[51] Int. Cl.[6] ..... G03G 15/30

[52] U.S. Cl. ..... 399/203; 358/474; 399/367

[58] Field of Search ..... 399/51, 43, 203, 399/177, 213, 215, 208, 365, 82, 367, 379; 358/474, 493, 486, 496, 497, 498, 296, 300

[56] References Cited

U.S. PATENT DOCUMENTS

| | | | |
|---|---|---|---|
| 4,442,460 | 4/1984 | Kurata et al. | 358/296 |
| 4,660,957 | 4/1987 | Ueda et al. | 355/233 X |
| 4,879,579 | 11/1989 | Yamamoto et al. | 355/234 X |
| 4,934,683 | 6/1990 | Ueda et al. | 271/3.04 |
| 4,935,775 | 6/1990 | Ueda et al. | 355/202 |
| 5,132,741 | 7/1992 | Kitajima et al. | 355/309 |
| 5,546,168 | 8/1996 | Adachi et al. | 399/51 |
| 5,617,196 | 4/1997 | Ueda et al. | 399/379 |

*Primary Examiner*—S. Lee

*Attorney, Agent, or Firm*—Fitzpatrick, Cella, Harper & Scinto

[57] ABSTRACT

The present invention provides an automatic original supplying apparatus which includes an original stacking plate on which originals can be rested, and an original conveyor for separating and supplying the original, one by one, and for conveying the separated original to a reading position. It operates in a flow reading mode in which a reader is fixed and the original is shifted with respect to the reader, a fix reading scan mode in which the original is fixed at the reading position and the reader is shifted with respect to the fixed original, and a count mode in which the number of originals is counted. The original conveying speed in the fix reading scan mode is faster than the original conveying speed in the flow reading mode, and, in the count mode, the original is conveyed under the flow reading mode.

17 Claims, 11 Drawing Sheets

AUTOMATIC ORIGINAL SUPPLYING APPARATUS HAVING COUNT MODE

This application is a continuation of application Ser. No. 08/535,842 filed Sep. 28, 1995, now abandoned.

BACKGROUND OF THE INVENTION

1. Field of the Invention

The present invention relates to an automatic original supplying apparatus operating in a count mode. Specifically, for example, the present invention relates to an automatic original supplying apparatus wherein originals resting on an original stacking plate are separated, one by one, and the separated original is conveyed to a reading position and then is returned to the original stacking plate. More particularly, it relates to an automatic original supplying apparatus operating in a count mode for counting the number of originals rested on the original stacking plate, and an image forming apparatus, such as a copying machine, having such an automatic original supplying apparatus.

2. Related Background Art

In the past, image forming apparatuses, such as a copying machine, having an automatic original supplying apparatus, have been proposed. Such an automatic original supplying apparatus comprises an original stacking plate on which a plurality of originals can be stacked, and an original convey means for separating the originals, one by one, and for conveying the separated original to a reading position and then for discharging the original onto the original stacking plate. Further, the original convey means operates in a flow reading mode in which a reading means is fixed and the original is read by the reading means while the original is being shifted with respect to the reading means, a sequence mode (fix reading mode) in which the original is fixed at a reading position and the original is read while the reading means is shifted with respect to the original, and a count mode in which the number of originals is counted. In the count mode, the apparatus previously recognizes the number of the originals before the job in one-face/both-face copy to permit proper page alignment (to prevent formation of blank in the first page) and idle conveyance of the original is effected in a jam recovery treatment.

In such conventional automatic original supplying apparatuses, when the original is conveyed in a condition that the original convey means is set to the count mode to count the number of the originals, the original is conveyed at a maximum original conveying speed equal to an original conveying speed in the fix reading mode.

In the fix reading mode, by rotating a pulse motor for driving the original convey means at a high speed and by stopping such a pulse motor intermittently to create a predetermined gap between a preceding original and a succeeding original before these originals are scanned, the originals are successively conveyed with a predetermined interval. In this case, the original is fixed (stopped) at the reading position, and the original is scanned by the reading means to read image information on the original.

However, in the count mode, in order to reduce an original change time, the acceleration and maximum speed of the original are increased during the original changing operation, with the result that noise and vibration become great. Further, since the original is temporarily stopped at the reading position and the original is maintained in the stopped condition to create the predetermined gap between the two successively conveyed originals, even when the originals are handled at a high speed, the original circulating time is not so reduced.

SUMMARY OF THE INVENTION

The present invention aims to eliminate the above-mentioned conventional drawbacks, and an object of the present invention is to provide an automatic original supplying apparatus which can reduce noise and vibration in a count mode by controlling conveyance of an original with low acceleration, reduce damage to the originals and reduce the original circulating time, and an image forming apparatus having such an automatic original supplying apparatus.

An automatic original supplying apparatus according to the present invention operating in a flow reading mode in which a reading means is fixed and the original is read by the reading means while the original is being shifted with respect to the reading means, a fix reading mode in which the original is conveyed to and fixed at a reading position and the original is read while the reading means is shifted with respect to the original, and, thereafter, the original is conveyed again, and a count mode in which the number of originals is counted. The original conveying speed in the fix reading mode is greater than an original conveying speed in the flow reading mode, and, in the count mode, the conveyance of the original is controlled so that the original is conveyed in the flow reading mode within an original change time equal to or greater than that in the fix reading mode.

Further, an image forming apparatus according to the present invention comprises the above-mentioned automatic original supplying apparatus, an image forming means for forming an image in response to image information which was read, and a sheet conveying means for supplying a sheet, one by one.

According to the automatic original supplying apparatus having the above-mentioned construction, in the count mode for counting the number of the originals, since the original is conveyed under the flow reading mode, i.e. since the original is not stopped at the reading position or, even if the original is stopped at the reading position, since the stopped time of the original is a minimum because such stopped time is time for determining the timing, the originals can be continuously conveyed without stopping the original convey means or with the minimum stoppage of the original convey means. As a result, the noise and vibration can be adequately suppressed. Further, in the count mode, by setting the original convey speed to the maximum original convey speed which is permitted in the apparatus, the original circulating time can be reduced.

DETAILED DESCRIPTION OF THE PREFERRED EMBODIMENTS

Figure 1:
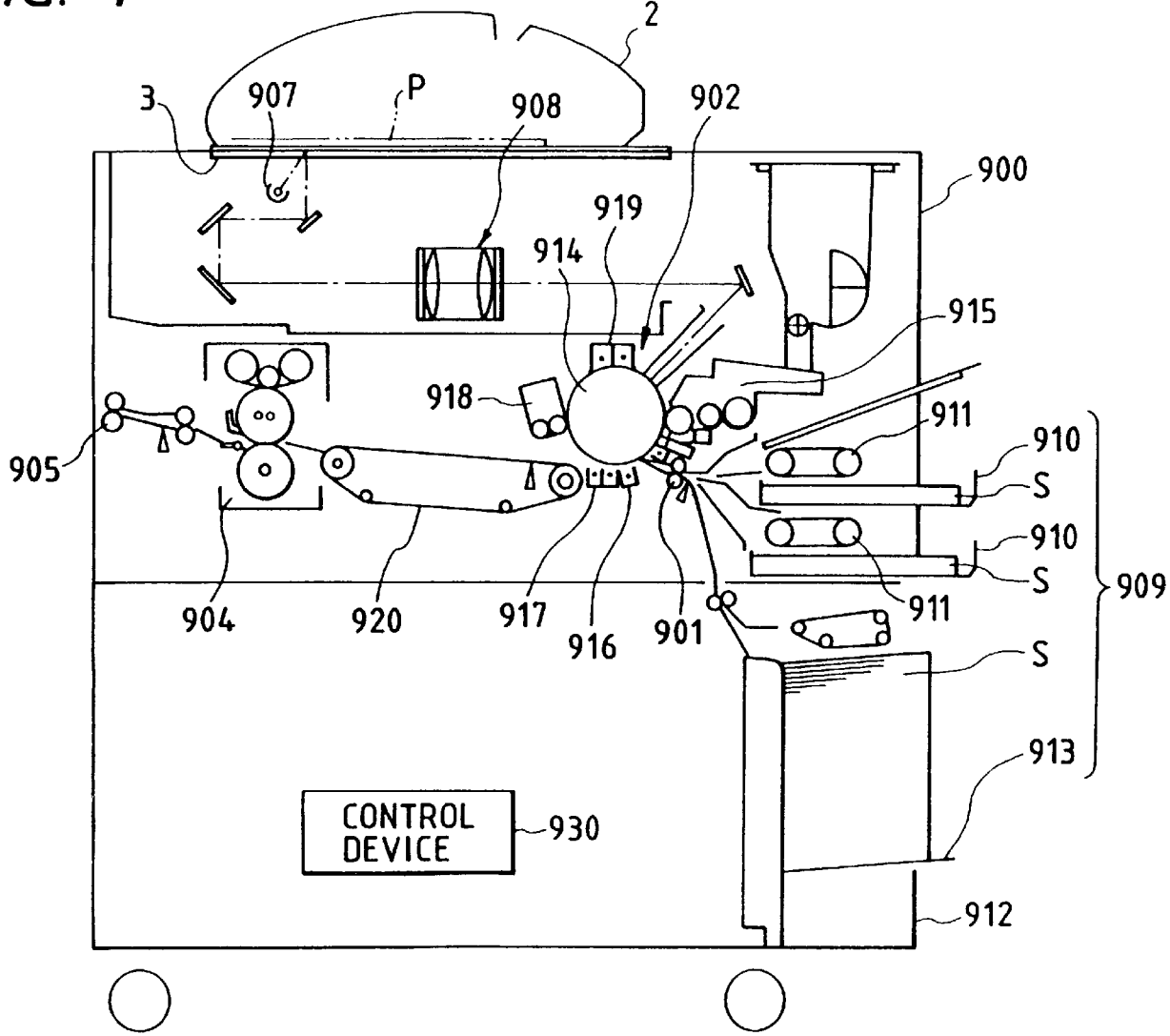
FIG. 1 is a schematic sectional view of a copying machine as an example of an image forming apparatus to which an automatic original supplying apparatus according to the present invention can be applied.

The present invention will now be explained with reference to the accompanying drawings. FIG. 1 is a schematic sectional view of a copying machine as an example of an image forming apparatus to which an automatic original supplying apparatus according to the present invention can be applied.

A copying machine 900 includes a platen glass (original reading portion) 3, a light source 907 and a lens 908 (reading means), a sheet supply portion 909, and an image forming portion 902. An automatic original supplying apparatus 2 is disposed above the platen glass 3.

The sheet supply portion 909 includes cassettes 910 which can contain sheets S and which can removably be mounted to the copying machine 900, a deck 913 disposed on a pedestal 912, and a sheet supply roller means (sheet convey means) 911 for supplying the sheet S to the image forming portion 902. The image forming portion 902 includes a cylindrical photosensitive drum 914, a developing device 915, a transfer charger 916, a separation charger 917, a cleaner 918, a first charger 919 and the like. A convey device (sheet convey means) 920, a fixing device 904 and discharge rollers 905 are disposed at a downstream side of the image forming portion 902.

Now, an operation of the copying machine having the above-mentioned construction will be briefly described.

When a sheet supply signal is outputted from a control device 930 of the copying machine 900, the sheet S is supplied from one of the cassettes 910 or from the deck 913. On the other hand, light emitted from the light source 907 and reflected by the original P rested on the platen glass 3 illuminates the photosensitive drum 914 through the lens 908. The photosensitive drum 914 is previously charged by the first charger 919. Thus, when the photosensitive drum is illuminated by the light, an electrostatic latent image is formed on the drum. This latent image is then developed by the developing device 915 to form a toner image.

The sheet S supplied from the sheet supply portion 909 reaches a pair of regist rollers 901, where the skew-feed of the sheet is corrected. And then, the sheet S is sent to the image forming portion 902 at a predetermined timing. In the image forming portion 902, the toner image formed on the photosensitive drum 914 is transferred onto the supplied sheet S by means of the transfer charger 916. Then, the sheet S to which the toner image was transferred is charged by the separation charger 917 with polarity opposite to that of the transfer charger 916, thereby separating the sheet from the photosensitive drum 914.

The separated sheet S is sent, by the convey device 920, to the fixing device 904, where the toner image is permanently fixed to the sheet S (by means of the fixing device 904). The sheet S on which the toner image was fixed is discharged out of the copying machine 900 by means of the discharge rollers 905.

In this way, after the image was formed on the sheet S supplied from the sheet supply portion 909, the sheet is discharged out of the copying machine.

Figure 2:
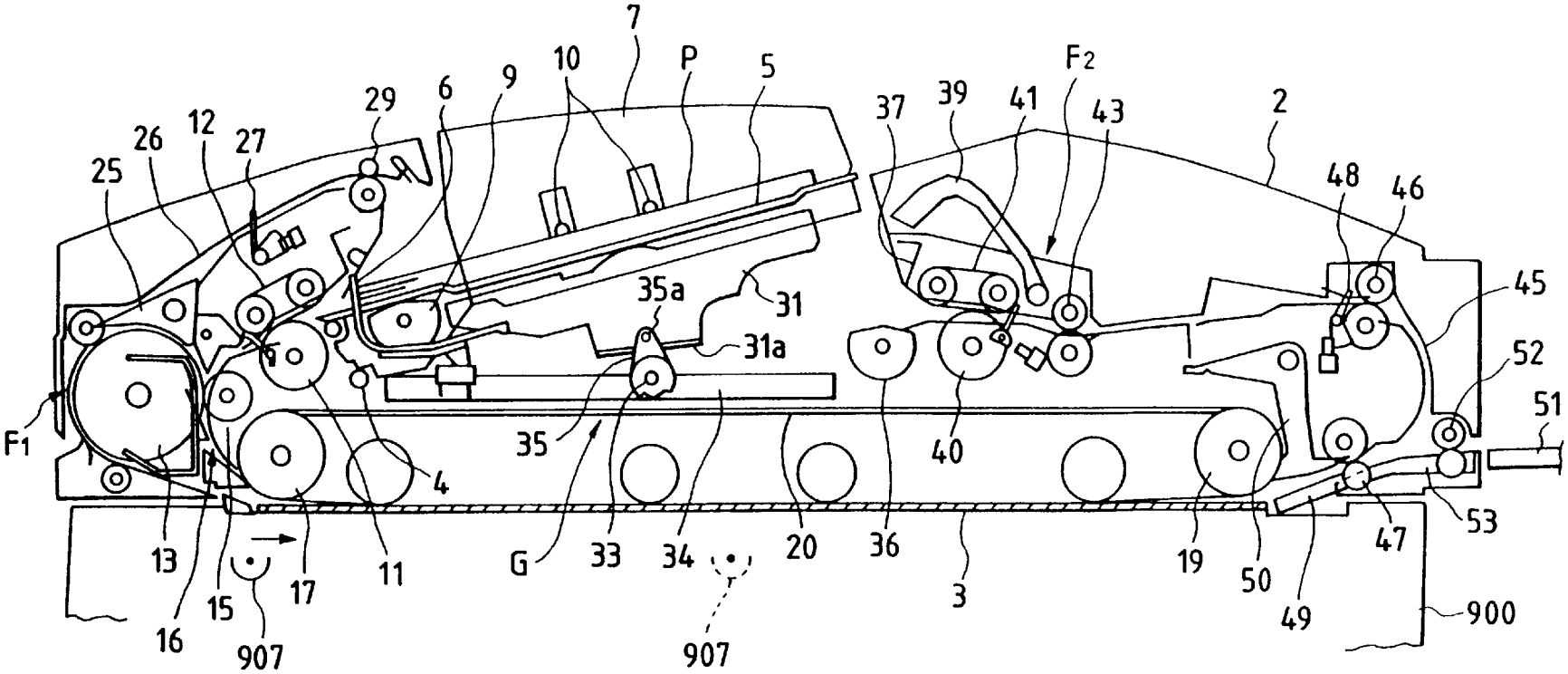
FIG. 2 is a schematic sectional view of the automatic original supplying apparatus according to the present invention.

FIG. 2 is a schematic sectional view of the automatic original supplying apparatus.

In FIG. 2, a pair of side guides 7 are slidably disposed on an original stacking plate 5 so that the plural originals P stacked on the original stacking plate are regulated in a widthwise direction by these guides, thereby aligning the originals with each other. A recycle lever 10, resting on the original stack P resting on the original stacking plate, serves to separate the originals P which are not treated from the originals P, which were treated and were returned to the original stacking plate. A shutter 6 serves to support tip ends of the originals on the original stacking plate to align the originals with each other and can be retarded downwardly from the original stacking plate 5 to permit the supply of the originals. The original stacking plate 5 can be rotated around a support shaft 4 between an inclined position (lifted position) shown in FIG. 2 and a horizontal position (lowered position) shown in FIG. 3.

In the position shown in FIG. 2, a lowermost original P is fed out from the original stack P resting on the original stacking plate by rotation of a first semi-circular feed-out roller 9.

A first supply and separation portion including a first convey roller 11 (rotated in an original supplying direction) and a separation belt 12 (rotated in an original returning direction) is disposed at a downstream side of the first feed-out roller 9. In the first supply and separation portion, the originals P fed out by the first feed-out roller 9 are separated one by one, and the separated original is conveyed downstream. A first pair of sheet supply rollers comprised of a large diameter roller 13 and a sheet supply roller 15 urged against the large diameter roller are disposed at a downstream side of the first supply and separation portion so that a first convey path 16 is provided by the first supply and separation portion and the first pair of sheet supply rollers.

An original convey means $F_1$ is disposed above the platen glass 3. The original convey means $F_1$ comprises an endless belt 20, a drive roller 17 and a driven roller 19. The reversible endless belt 20 wound around the drive roller 17 and the driven roller is urged against the platen glass 3 so that the original P is conveyed onto the platen glass 3 at a predetermined timing by rotating the endless belt 20 in a normal direction. The original P stopped at a reading position is scanned by the light source 907, thereby reading an image on the original in a fix reading mode.

After the original P was read, the original P is conveyed into a convey path disposed outside of the large diameter roller 13 by reverse rotation of the endless belt 20 to reach a flapper 25. The flapper 25 serves to reversely rotate (turn over) the original P and then to guide the original to the platen glass 3 when the both faces of the original are read, and serves to guide the original P to a pair of discharge rollers 29 through a sheet discharge path 26 when only a single face of the original P is read. The original P, discharged by the pair of discharge rollers 29, is discharged on the recycle lever 10 so that the discharged originals P are discriminated from the non-supplied originals P on the original stacking plate 5 by means of the recycle lever 10.

Incidentally, the original convey means $F_1$ also includes the above-mentioned first supply and separation portion.

Figure 3:
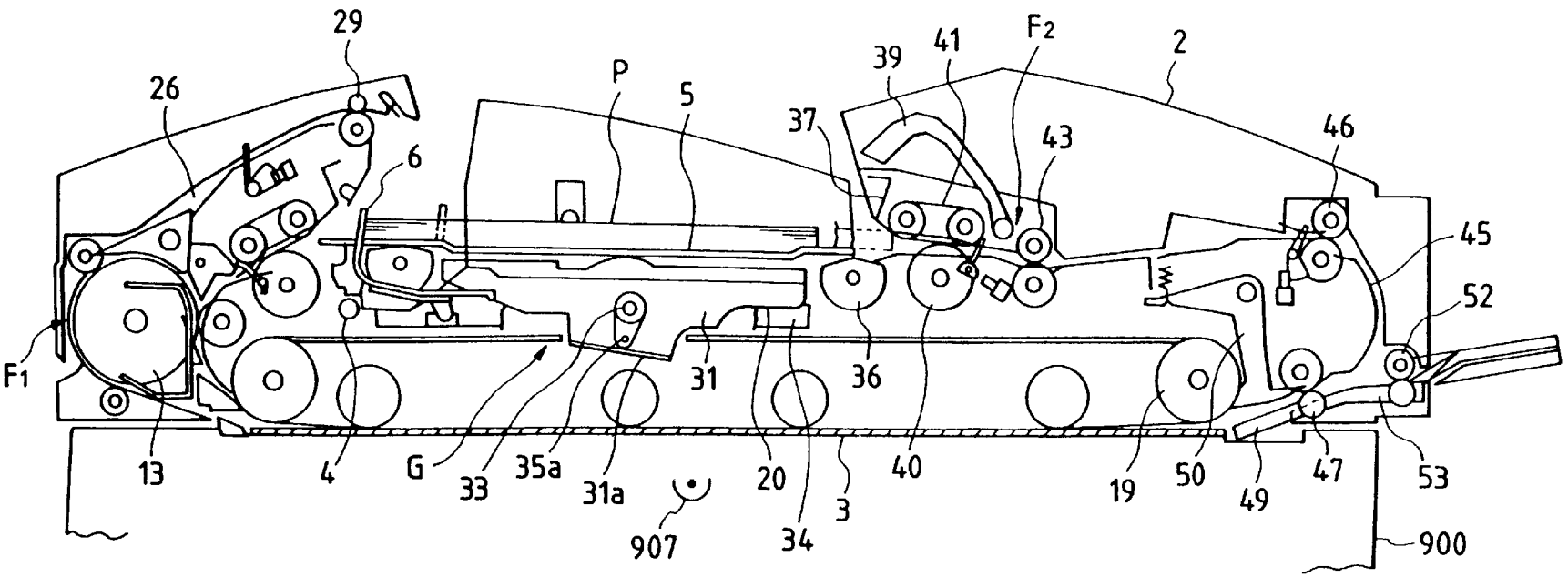
FIG. 3 is a schematic sectional view of the automatic original supplying apparatus in another condition.

On the other hand, when the original stacking plate 5 is positioned as shown in FIG. 3, the original P is conveyed from its trail end through a second convey path 45 to the platen glass 3.

At a side adjacent to the trail end of the original stack P resting on the original stacking plate 5, there are disposed a second semi-circular feed-out roller 36 for supplying the lowermost original P from the original stack, and an original convey means $F_2$ having substantially the same construction as that of the above-mentioned original convey means $F_1$. That is to say, the original convey means $F_2$ includes a guide plate 37, a weight 39 for urging the original P against the second feed-out roller 36, a convey roller 40 rotated in an original supplying direction, a separation belt 41 rotated in an original returning direction, the drive roller 17, the driven roller 19 and the endless belt 20. When the originals P are fed out from the original stacking plate downstream by means of the second feed-out roller 36, the originals are separated, one by one, by means of a second supply and separation portion comprised of the convey roller 40 and the separation belt 41.

A second convey path 45 for conveying the separated original P to the platen glass 3 having the reading position is disposed at a downstream side of the second supply and separation portion comprised of the convey roller 40 and the separation belt 41. The second convey path 45 includes a pair of convey rollers 43, a relay sensor 48, a relay roller 46, and a pair of sheet supply rollers 47. A shiftable guide member 50 for directing the original P to the platen glass 3 or guiding the original P on the platen glass 3 is disposed between an upper roller of the pair of the sheet supply rollers 47 and the driven roller 19 associated with the endless belt 20.

The original P separated by the second supply and separation portion is conveyed through the second convey path 45 and the shiftable guide member 50 and is guided onto the platen glass 3 by the driven roller 19. The original P conveyed on the platen glass 3 is passed by the light source 907 which is now fixed; meanwhile, a flow reading mode is effected. Thereafter, the original P is conveyed to the discharge path 26 through the path disposed outside of the large diameter roller 13 and then is discharged onto the original stacking plate 5 by means of the pair of discharge rollers 29.

In the illustrated embodiment, the original stacking plate 5 can be rotated around the support shaft 4 between the inclined position (lifted position) shown in FIG. 2 and the horizontal position (lowered position) shown in FIG. 3, and the original stacking plate is shifted between the inclined position and the horizontal position by means of an ascent/descent drive device (ascent/descent means) G for lifting and lowering the original stacking plate 5. That is to say, as shown in FIGS. 2 and 3, the ascent/descent drive device G comprises a drive source such as a motor (not shown), a connection shaft 33 connected to the drive source, drive members 35, fixed on both ends of the connection shaft 33, a frame 31, having bent pieces 31*a* urged by drive pins 35*a* provided on free ends of the drive members 35 and secured to the original stacking plate 5, a support member (not shown) integral with the frame 31, the support shaft 4 for rotatably supporting the support member, and compression springs (not shown) for biasing the frame 31 upwardly.

In FIG. 2, when the drive source such as the motor (not shown) is rotated in a counter-clockwise direction, the connection shaft 33, drive members 35 and drive pins 35*a* provided on the drive members are also rotated in the counter-clockwise direction. As a result, the frame 31 and the original stacking plate 5 are rotated around the support shaft 4 to be lifted by the biasing force of the compression springs (not shown), so that the original stacking plate 5 reaches the inclined position to form a switch-back path including the first convey path 16.

On the other hand, in FIG. 3, when the drive source, such as the motor (not shown), is rotated in a clockwise direction, the connection shaft 33, drive members 35 and drive pins 35*a* provided on the drive members are also rotated in the clockwise direction. As a result, the frame 31 and the original stacking plate 5 are rotated around the support shaft 4 to be lowered, so that the original stacking plate 5 reaches the horizontal position to form a closed path including the second convey path 45.

In the automatic original supplying apparatus 2 having the above-mentioned construction, when the original P on the original stacking plate 5 is conveyed through the closed path, i.e. closed loop path (FIG. 3), the apparatus operates in the following three modes.

A. Flow Reading Mode (1) Original Convey Control

The original is continuously shifted without stopping the original at the reading position.

(2) Light Source Control

The light source 907 constituting a part of the reading means is fixed at the reading position, and the image on the original which is being shifted is read.

(3) Original Shifting Speed Control

V1 or V1max (V1<V1max)

B. Fix Reading Mode (1) Original Convey Control

The original is shifted up to the reading position and is fixed (stopped) at that position, and then is shifted again.

(2) Light Source Control

The light source 907 is shifted with respect to the stopped original, thereby reading the image on the original.

(3) Original Shifting Speed Control

V2 (V2>V1)

C. Count Mode (1) Original Convey Control

The conveyance of the original is controlled in the flow reading mode.

(2) Original Shifting Speed Control

V1max (V2>V1max)

Next, the handling of the flow reading mode, the fix reading mode and the count mode will be explained.

First of all, the flow reading mode will be described.

Now, the flow of the sheet in "a mix mode" effected together with the fix reading by supplying the sheet from the right will be explained with reference to FIGS. 4A to 9E.

Figure 4A:
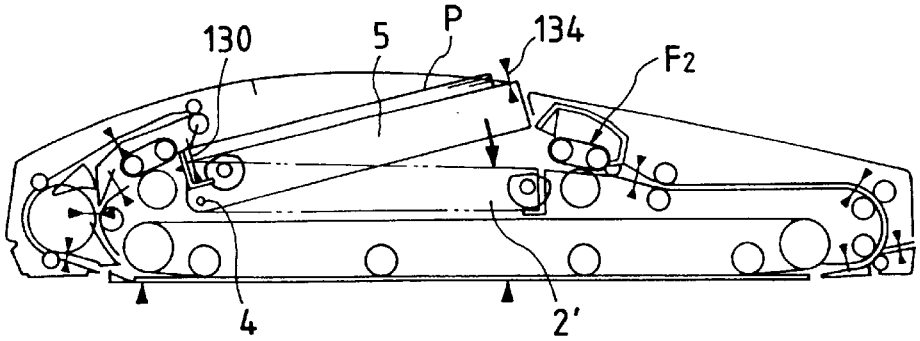
FIGS. 4A to 4D, 5E to 5H, 6I to 6L and 7M to 7P are schematic illustration for explaining movements of originals in a mix mode.
Figure 4B:
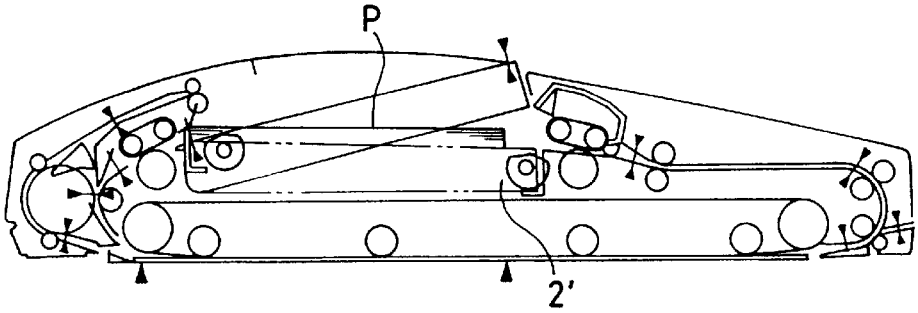

First of all, FIG. 4A shows the condition that the originals P are set on the original stacking tray. In this condition, an empty sensor 130 detects the presence of the original. When an original set sensor 134 is turned OFF, i.e. when the originals are contained within a predetermined containing space, and when a copy start signal emitted from the copying machine is information designating the mix mode, the original stacking plate 5 is rotated around the support shaft 4 to be lowered to the lowered position 2' (shown by the two-dot and chain line). When the lowering movement of the original stacking plate is finished, the original stack P is bundle-conveyed to the right by the shutter 6 until the tip end (right end) of the original stack passes through the original set sensor 134 and reaches a predetermined position (where the original is effectively separated by the supply and separation means $F_2$).

Figure 4C:
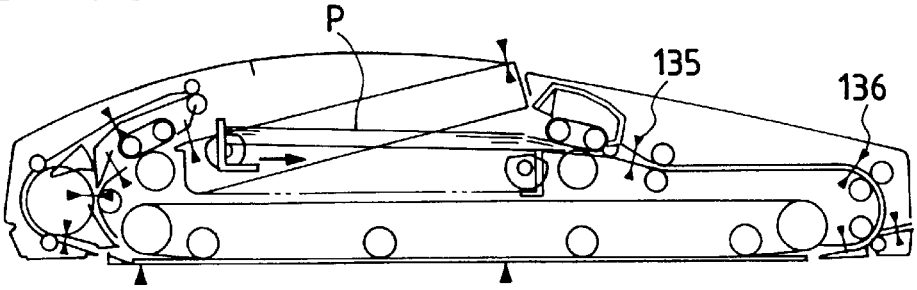
Figure 4D:
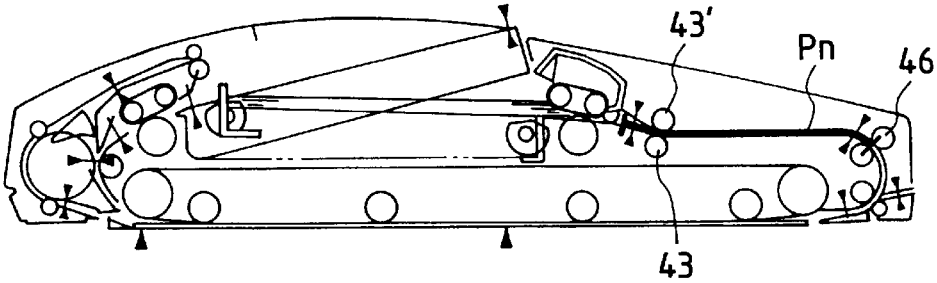

Then, the lowermost original $P_n$ is fed out from the original stack P (FIGS. 4C and 4D). FIG. 4D shows a condition that the original $P_n$ abuts against a nip between the regist rollers 46. The regist rollers 46 serve to correct the skew-feed of the original (the tip end of the original abuts against the nip of the regist rollers 46 which are now stopped and a loop is formed in the original between the regist rollers and the upstream convey rollers 43, 43', thereby correcting the skew-feed of the original). After a predetermined time period is elapsed, the regist rollers 46 start to rotate, thereby starting the conveyance of the original $P_n$.

Figure 5E:
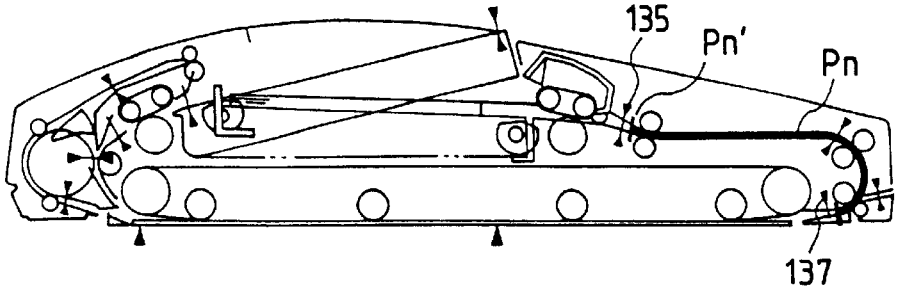

FIG. 5E shows the condition that the trail end of the original $P_n$ has just passed through the original set sensor 134. In this condition, the separation and supply of a next original $P_{n-1}$ is started. In the condition shown in FIG. 4D, after the regist loop is formed in the original, since a drive source for the regist rollers 46 is different from a drive source for the convey rollers 43, 43', although the speed of the regist rollers may differ from that of the convey rollers, a clock disk is provided on a roller shaft of the driven convey roller 43' so that the conveying speed of the original $P_n$ is checked by the clock disk and a clock count sensor. In this way, the regist rollers 46 are controlled on the basis of output from the clock count sensor so that they are rotated at a peripheral speed in synchronism with the conveying speed of the original $P_n$ (That is to say, the rotational speed of a stepping motor 164 for driving the regist rollers is controlled in synchronism with the conveying speed of the original).

As will be fully described later, immediately before the tip end of the original $P_n$ is pinched between back-up rollers 47 (which can be rotated by the driving action of the endless belt 20), the same speed control between the convey rollers 43, 43' and the regist rollers 46 (convey roller/regist roller same speed control) is changed to the belt/regist roller same speed control wherein the peripheral speeds of the endless belt 20, back-up rollers 47 and regist rollers 46 become the same as each other by synchronizing the clock for driving the endless belt (i.e. the stepping motor 151 for driving the endless belt 20) with the stepping motor 164 for driving the regist rollers.

In a condition (refer to FIG. 5H) immediately after the same speed control is changed, although the trail end of the original is pinched between the convey rollers 43, 43', since a one-way clutch for permitting the free rotation of the convey rollers in the original conveying direction is provided in association with the convey rollers, even when the peripheral speed of the convey rollers is faster than the peripheral speed of the regist rollers, the original can be drawn from the nip between the convey rollers by the peripheral speed of the regist rollers 46. Returning to FIG. 5E, this figure shows the condition that the trail end $P_n$' of the original leaves from the nip between the convey rollers 43, 43' by the belt/regist roller same speed control.

Figure 5F:
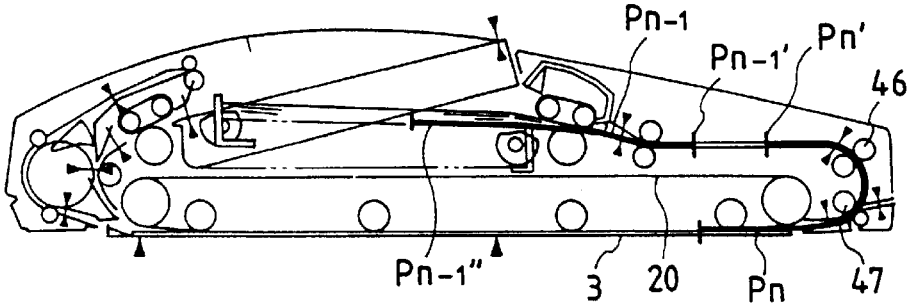

In a condition shown in FIG. 5F, the endless belt 20, back-up rollers 47 and regist rollers 46 are controlled to become the same speed as each other by the belt/register roller same speed control and the tip end of the original $P_n$ enters into the platen glass 3. In this condition, the tip end $P_{n-1}$' of the next original $P_{n-1}$ has passed through the nip between the convey rollers 43, 43' and the next original $P_{n-1}$ is being conveyed at a speed that the tip end $P_{n-1}$' does not catch up with the trail end $P_n$' of the original $P_n$. Further, before the trail end $P_{n-1}$" of the original $P_{n-1}$ being conveyed by the convey rollers 43, 43' driven by the separation motor 152 passes through the nip of the supply and separation means F2, a separation clutch 170 is turned OFF, with the result that, although the convey rollers 43, 43' continue to be rotated, the supply and separation means F2 is stopped. Thereafter, the original $P_{n-1}$ is drawn from the supply and separation means F2 by means of the convey rollers 43, 43'.

Figure 5G:
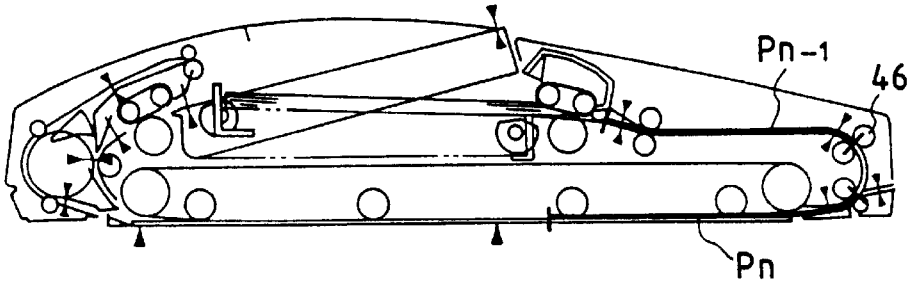

With this arrangement, a good separating function can be achieved. In order to reduce the load generated during the above-mentioned drawing, one-way clutches are incorporated into the feed roller (convey roller) 40 and the auxiliary convey roller (semi-circular roller) 36 to permit the free rotation of these rollers in the original conveying direction. FIG. 5G shows a condition that the originals $P_n$, $P_{n-1}$ are further conveyed. Regarding the original $P_{n-1}$, similar to the original $P_n$, the regist loop is formed by the regist rollers 46, thereby correcting the skew-feed of the original $P_{n-1}$.

Figure 5H:
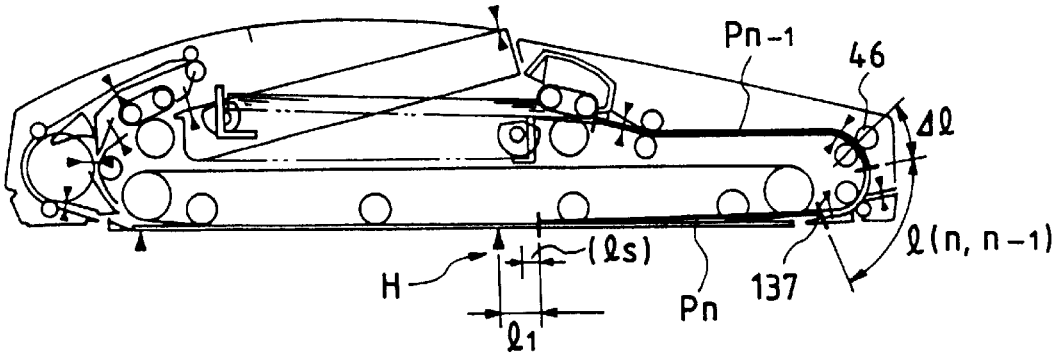

FIG. 5H shows a condition that the tip end of the original $P_n$ is temporarily stopped at a position spaced apart from a flow reading image tip (second image tip) position H by a predetermined distance $l_1$. In this case, the trail end of the original $P_n$ is not pinched between the upstream side pair of convey rollers so that the original is not influenced by any drive sources other than the endless belt 20 which performs the flow reading and exposure scanning, and the brakes and the like are released when the drive condition is ceased (In the illustrated embodiment, while it is described as "immediately stopped", it may not be stopped). In this case, the original $P_{n-1}$ has just protruded from the nip of the regist rollers 46 by a predetermined amount ($\Delta l$) by the convey roller/regist roller same speed control. Thus, in this case, the trail end of the original $P_n$ is spaced apart from the tip end of the original $P_{n-1}$ by a distance $l_{(n,n-1)}$.

In this way, in the flow reading mode, since the spacing between the preceding original and the succeeding original is substantially completed when the preceding original to be scanned is positioned on the platen glass, the original convey control permits the continuous conveyance of the originals while keeping the original-to-original distance constant (to minimize the loss time for the spacing treatment).

Further, the tip end of the original $P_n$ has been advanced by a distance corresponding to a predetermined number of clock pulses after the tip end of the original $P_n$ passes through the image tip sensor 137, and, in a control circuit (not shown), the distance $l_1$ is always being recognized. In the condition shown in FIG. 5H, when an image permit signal (stand-by signal) is emitted from the copying machine, the speed of the original $P_n$ becomes the same as the process speed of the copying machine after the original is conveyed by an entrance length $l_s$ ($l_s<l_1$) (in the same magnification copy mode). In the magnification change copy mode, the original is handled with a relative speed difference (the difference between the original handling speed and the copy sheet conveying speed) by selecting a predetermined flow reading speed with respect to the process speed of the copying machine in accordance with the magnification.

Figure 6I:
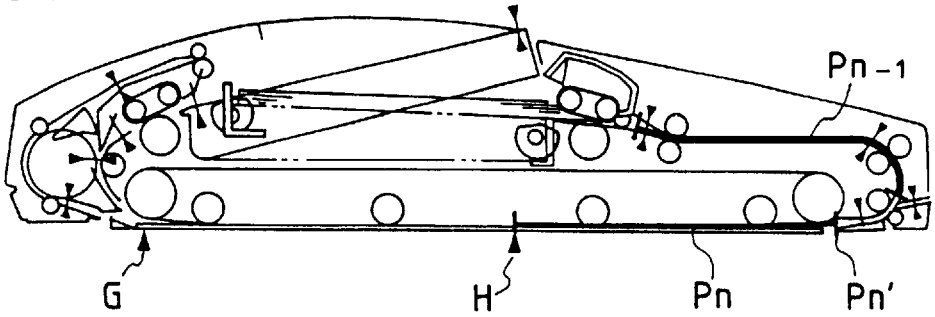

When the tip end of the original $P_n$ is aligned with the flow reading image tip (second image tip) H by the control circuit (not shown) for determining the convey amount of the tip end of the original $P_n$ (i.e., the total number of clock pulses for bringing the tip end of the original $P_n$ to the flow reading image tip H indicating a certain time period has elapsed after the tip end of the original $P_n$ was passed through the image tip sensor 137), the image tip signal is emitted from the original supplying apparatus, thereby starting the image formation with respect to the photosensitive drum 914 of the copying machine (FIG. 6I). In this case, since the original conveying speed is the same as the process speed of the copying machine, the flow reading mode is used wherein the image is read while the original is being conveyed (but, the optical system is stopped or fixed).

After the flow reading of the original $P_n$ at the constant speed was finished, when the trail end $P_n$' of the original $P_n$ has just passed through the flow reading image tip H (the position of the trail end is ascertained or recognized by the control circuit on the basis of the endless belt convey clocks), an optical system return signal (when two or more same copies are desired) emitted from a control circuit (not shown) of the original supplying apparatus is sent to the control circuit of the copying machine, with the result that the exposure portion 907 of the optical system is shifted to the first image tip G.

Figure 6J:
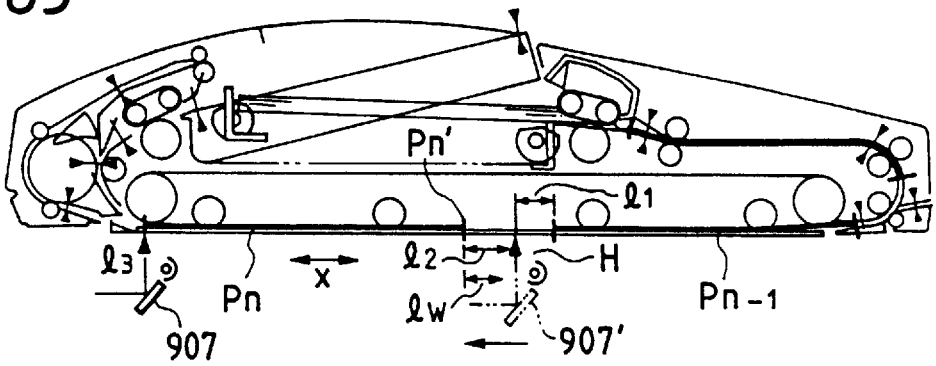
Figure 6K:
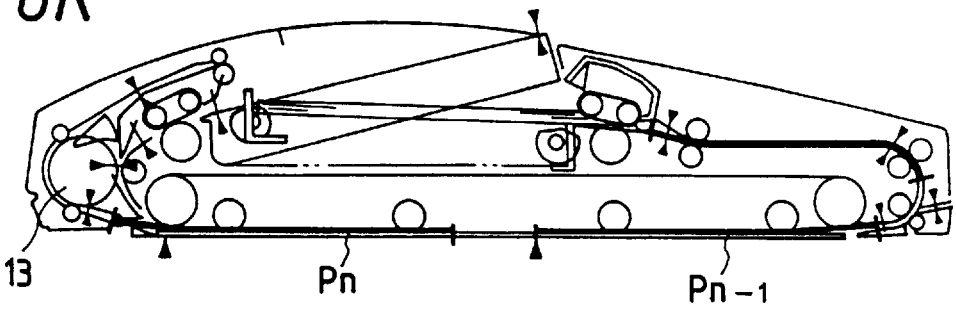

FIG. 6J shows a condition that the exposure portion 907 of the optical system is shifted from the second image tip H to the first image tip G. After the flow reading of the original $P_n$ is finished, when the tip end of the original reaches an $l_3$ image tip (fix reading image tip), the endless belt 20 is stopped, and the original $P_n$ (and the original $P_{n-1}$) are also stopped (FIG. 6J). In this case, the positions of the originals $P_n$, $P_{n-1}$ are recognized by the control circuit (not shown) of the original supplying apparatus on the basis of the endless belt convey clocks. In the condition shown in FIG. 6J, when the number of same copies is set to m, for second to (m−1)th scanning operations, the original $P_n$ is scanned by reciprocally shifting the exposure portion 907 of the optical system (in an X direction).

Of course, when the number of same copies is set to 1 (one), since a single copy can be obtained by fixing the exposure portion 907 of the optical system at the flow reading image tip position H, and by effecting the flow reading while the original $P_n$ is being shifted, the succeeding originals $P_{n-1}, P_{n-2}, \ldots, P_1$ may be read by the flow reading mode under the condition that the exposure portion 907 of the optical system is fixed at the flow reading image tip position H. However, each original is temporarily stopped at the fix reading position for a time shorter than the stop time in the fix reading mode.

By permitting the continuous scanning of the originals regarding both the flow reading and the fix reading by setting the number of the same copies in this way, when the number of copies is set within the capacity of the output side for receiving the copy sheets, e.g. the capacity of the sorter (more particularly, the number of bins of the sorter), the scanning operations corresponding to the number of copies can be completed during the original supplying operation in a single circulation of the original stack $P_n$. In a conventional flow reading scan, performing the circulations corresponding to the number of copies was required. In contrast according to the illustrated embodiment of the present invention, by performing the flow reading scan and the fix reading scan in the series of original supplying operations, not only all of the scans can be completed in a single circulation of the original stack (when the number of copies is set within the capacity of the sorter) but also a single scan can be completed within the original changing operation. Further, the original change speed may be slower than the scanning speed (The conventional original change speed was considerably faster than the scanning speed (1000–1300 mm/sec).

Returning to FIG. 5H, after the tip end of the original $P_{n-1}$ is advanced from the nip of the regist rollers 46 by the predetermined amount of Δl under the convey roller/regist roller same speed control, the convey roller/regist roller same speed control is changed to the belt/regist roller same speed control. As a result, the original $P_{n-1}$ starts to shift from the condition shown in FIG. 5H, and, after the tip end of the original $P_{n-1}$ passes through the image tip sensor 137, the count of the convey clocks for the original $P_{n-1}$ is started.

When the original $P_{n-1}$ is stopped at the position shown in FIG. 6J, this stop position is determined by the previous original $P_n$. However, the convey clocks, until the original $P_{n-1}$ reaches the flow reading image tip position H, are counted from after the tip end of the original $P_{n-1}$ passes through the image tip sensor 137, and, since the distance between the flow reading image tip position H and the image tip sensor is constant, under the condition (FIG. 5H) that the tip end of the original $P_{n-1}$ is shifted from the position shown in FIG. 6J to the flow reading image tip position H, when the flow reading is started in response to the image tip signal from the control circuit of the original supplying apparatus, the registration accuracy of the original is ensured.

Regarding the other originals $P_{n-2}, \ldots$, the flow reading and registration are effected under similar control. Incidentally, although the distance $l_1$ to the flow reading image tip position H regarding the original $P_n$ and the distance $l_2$ to the flow reading image tip position H regarding the original $P_{n-1}$ are varied more or less due to the dispersion of the predetermined heading distance Δl provided by the regist rollers 46, as mentioned above, since the point to which each original reaches is determined by the number of clocks counted from the image tip sensor 137, the fluctuation in the flow reading image tip position (i.e. reading start position for the flow reading) H and the original tip end stop position for the fix reading can be minimized, with the result that stable registration accuracy of the tip end of the original can be ensured in both flow reading and fix reading operations.

In FIG. 5H, after the fix reading operations (in which the original is conventionally fixed and the optical system is conventionally shifted) are finished by (m−1) times (m is the number of same copies; 1 is the number for which the flow reading is effected), the original $P_n$ is sent toward the pair of reverse rotation rollers 13 to be discharged. The reverse rotation rollers 13 are driven by means of a reverse rotation motor 155 under PLL control so that the peripheral speeds of the reverse rotation rollers become the same as the peripheral speed of the endless belt 20, with the result that, even when the original to be discharged is conveyed by straddling between the endless belt and the reverse rotation rollers, the extension and compression of the original can be minimized.

Figure 6L:
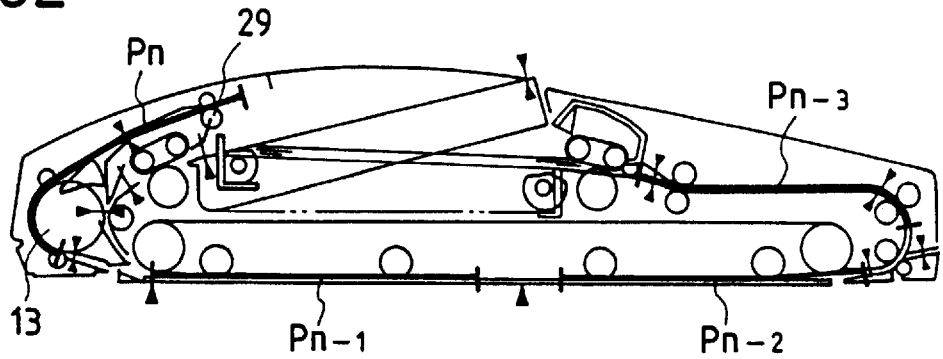
Figure 7M:
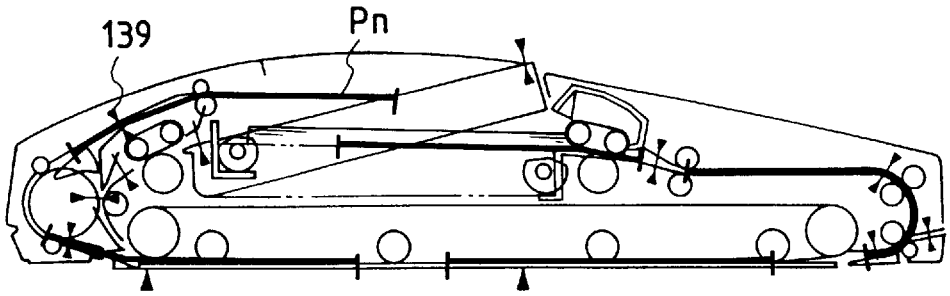

In FIG. 6L, the tip end of the original $P_n$ is pinched between the paired discharge rollers 29. The discharge rollers 29 are driven by means of a discharge motor 161 so that they are rotated at a speed greater than the peripheral speeds of the endless belt and the reverse rotation rollers. However, when the original is conveyed by straddling between the reverse rotation rollers 13 and the discharge rollers 29, the movement of the original is governed by the reverse rotation rollers 13 having the stronger conveying force. And, after the trail end of the original leaves the nip between the reverse rotation rollers 13, the original is conveyed merely by the discharge rollers at a speed providing good discharging ability and stacking ability (FIG. 7M).

More specifically, when the original $P_n$ leaves the nip between the reverse rotation rollers 13, the original $P_n$ is temporarily conveyed at the speed greater than the peripheral speed of the reverse rotation rollers 13 to increase the distance between this original $P_n$ and the succeeding original $P_{n-1}$. And, when the trail end of the original $P_n$ has just passed through a discharge sensor 139, the speed of the original $P_n$ is decreased to the speed providing the good discharging ability and the stacking ability (in the illustrated embodiment, line speed of 200–400 mm/sec).

Figure 7N:
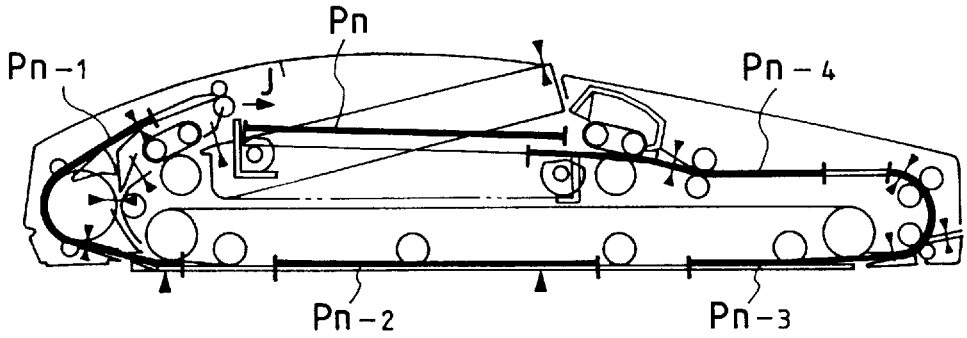
Figure 7O:
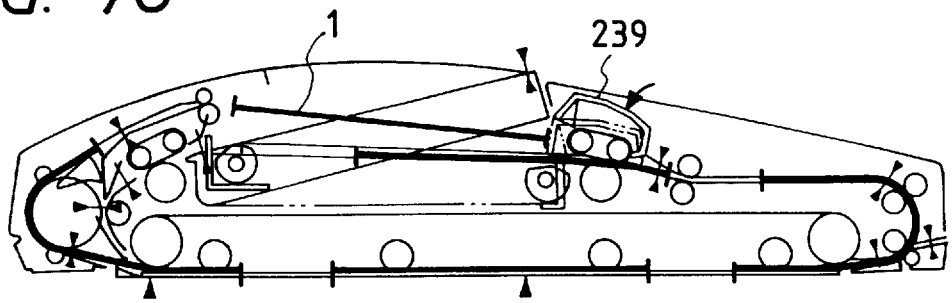

In FIG. 7N, the discharged original $P_n$ is resting on the non-treated original stack. In this condition, when a predetermined time period is elapsed, the shutter 6 is driven by the shutter driving stepping motor to shift the original in a direction shown by the arrow J (FIG. 7N), thereby jog-aligning the originals.

The above-mentioned handling operation of the original is repeated, and, after the last original P of the original stack in the next to last circulation (among the plural circulations when the number of same copies exceeds the capacity of the output side) was discharged and before the first original in the last circulation is discharged, a partition member 239 rests on the original stack P (FIG. 70). The partition member 239 is driven by a solenoid. That is to say, when the solenoid is turned ON, the partition member 239 is lowered onto the original stack by its own weight so that the originals of the last circulation discharged on the original stacking plate can be prevented from entering into the supply and separation portion F2 (The force of the partition member for urging the original stack is very small so that the urging force does not positively help the supply of the lowermost original by means of the supply roller 36).

Figure 7P:
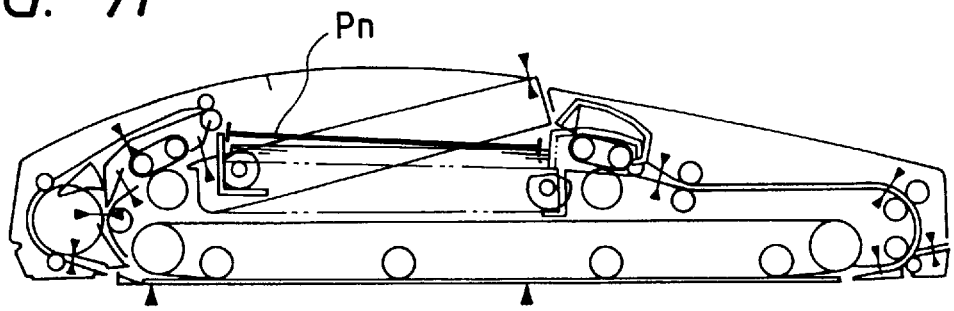
Figure 8A:
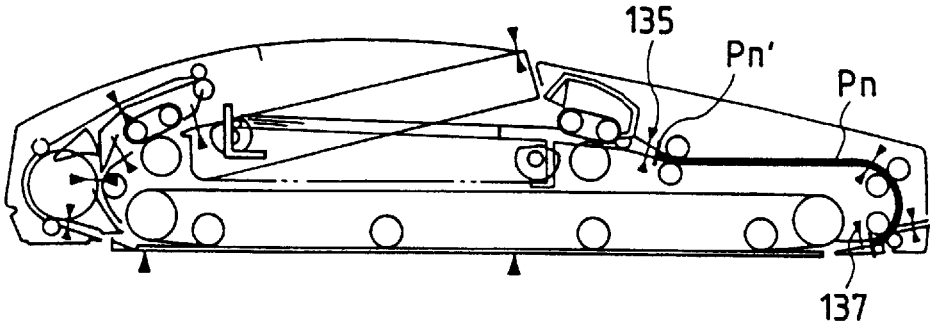
FIGS. 8A, 8B and 9C to 9E are schematic illustration for explaining movements of originals in a fix reading mode.
Figure 8B:
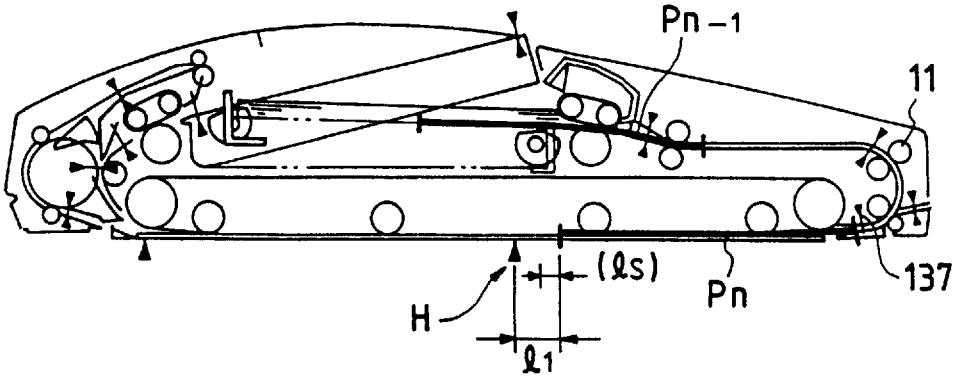

FIG. 7P shows a condition that the last original $P_n$ of the last circulation is discharged. After this original $P_n$ was discharged, the original stacking plate 5 is lifted to the initial position (original setting position) (FIG. 8A). Then, the original stack P is bundle-conveyed by the shutter until the tip end of the original stack slightly protrudes from the end of the original stacking plate 5, thereby facilitating the removal of the original stack.

Figure 9C:
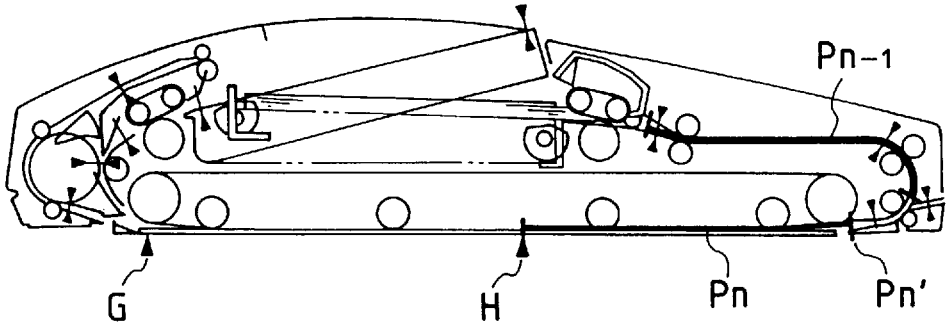
Figure 9D:
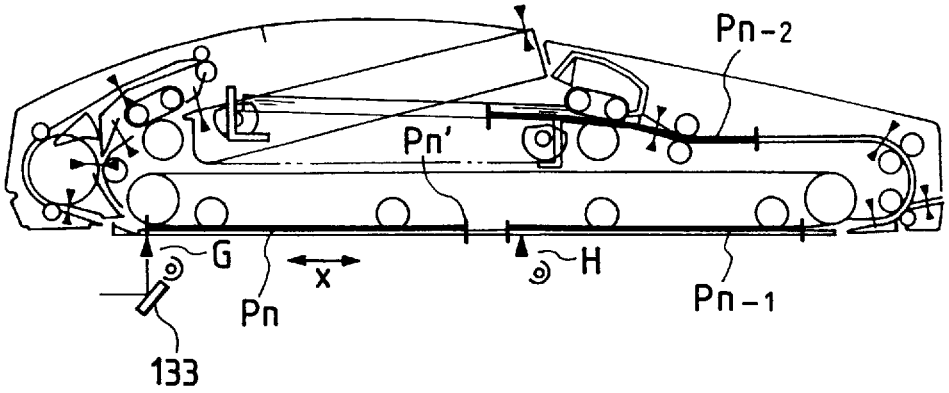
Figure 9E:
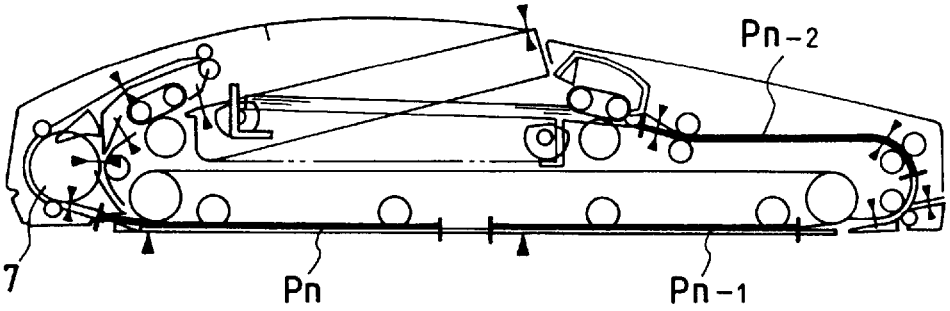
Figure 10:
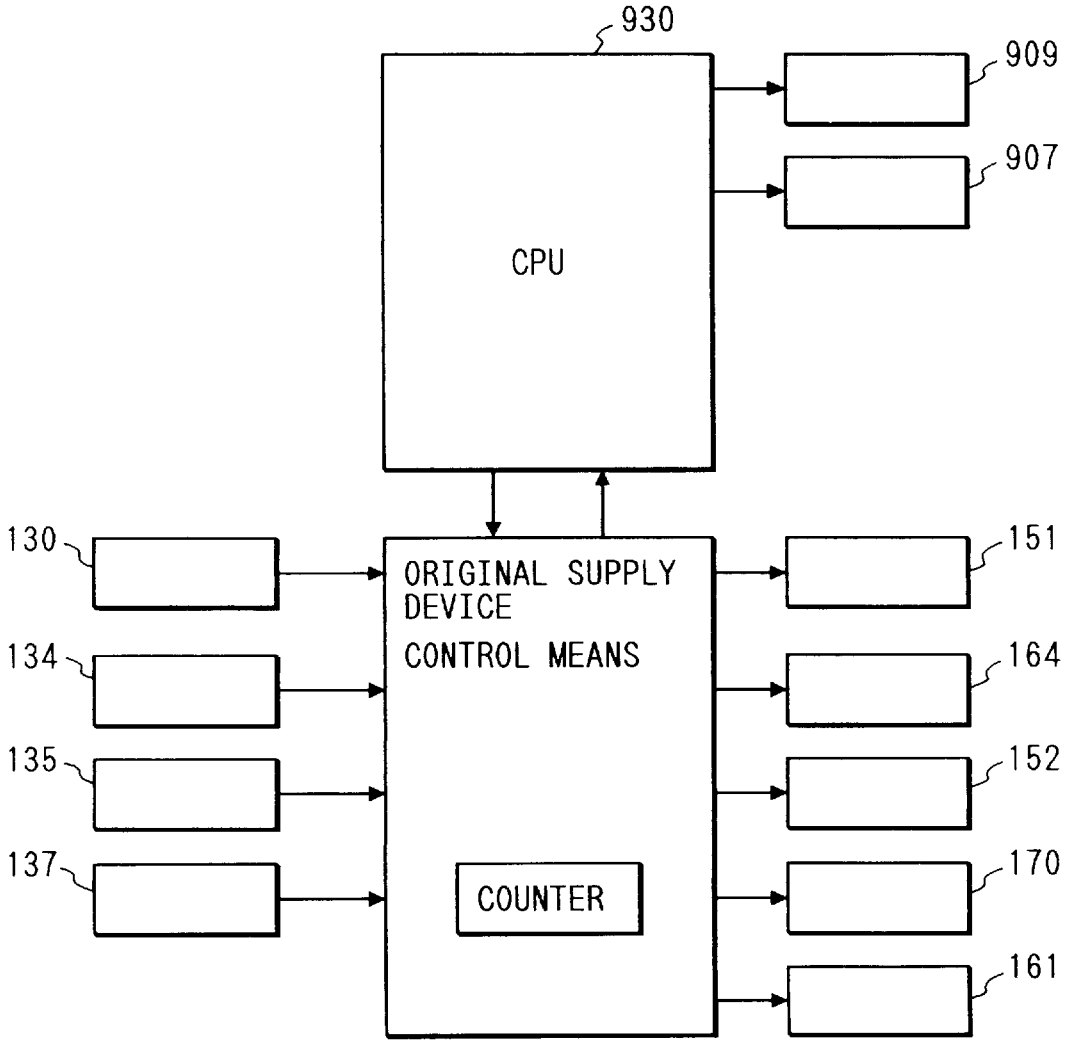
FIG. 10 is a block diagram.
Figure 11:
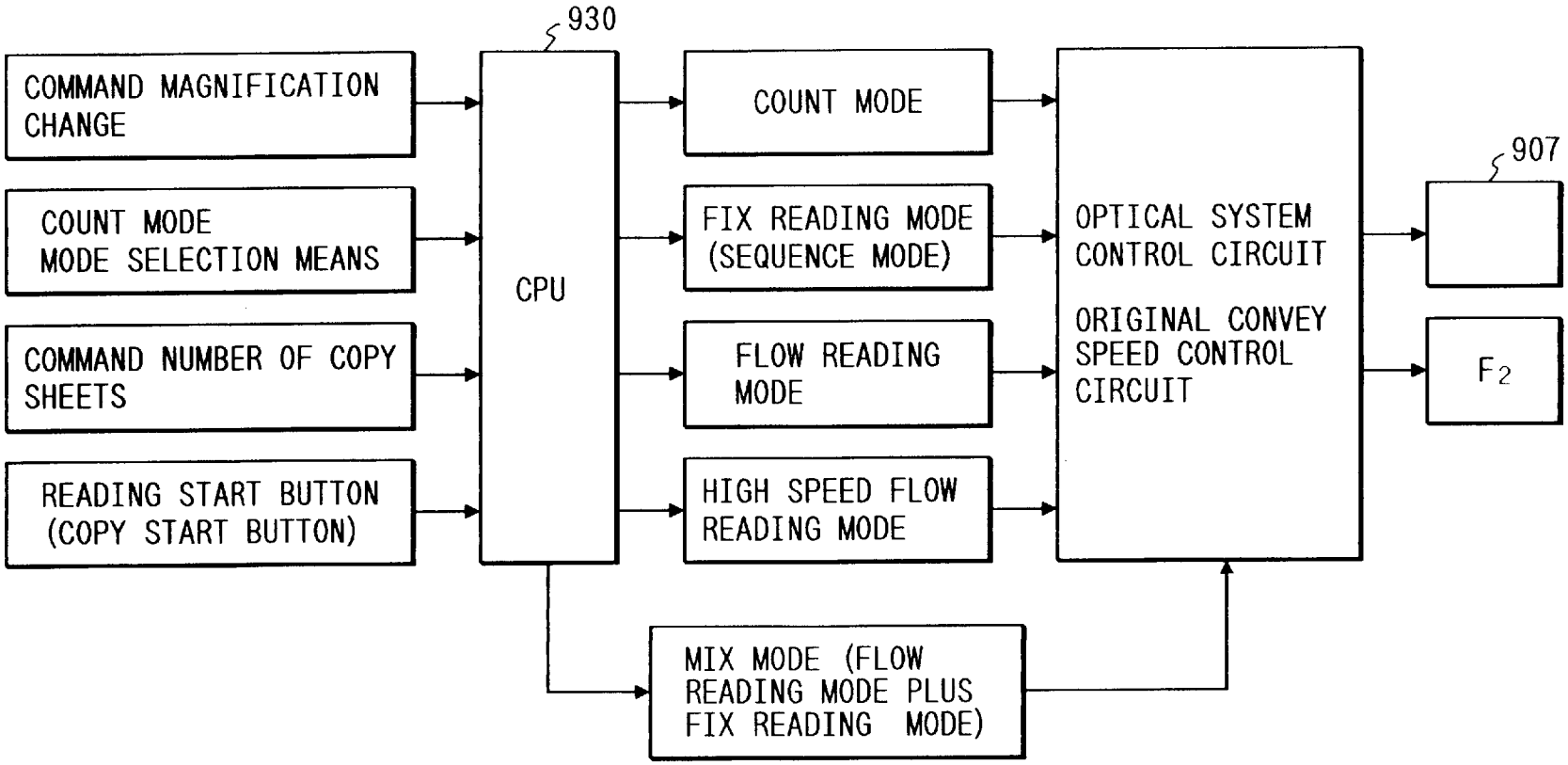
FIG. 11 is a block diagram.

Next, control of the conveyance of the original during the fix reading scan mode will be explained. Fix reading is effected in the sequence mode, so that the originals are continuously supplied. The sequence mode is performed when the mix mode cannot be used (magnification change). In the flow reading mode, as shown in FIGS. 5E and 5F, pursuant to the original $P_n$, the next original $P_{n-1}$ is successively supplied with a predetermined distance between these originals. However, in the sequence mode during the fix reading mode, normally, since the conveyance of the originals is controlled in such a manner that, while the original $P_n$ is scanned by the optical system, the original $P_{n-2}$ is conveyed (for distance adjustment) so that the distance between the original $P_{n-1}$ and the original $P_{n-2}$ is equalized to the distance between the original $P_n$ and the original $P_{n-1}$, the original $P_n$ and the original $P_{n-1}$ are stopped until the distance between the original $P_n$ and the original $P_{n-1}$ becomes the same as the distance between the original $P_{n-1}$ and the original $P_{n-2}$ (FIGS. 9C to 9E).

Next, control of the conveyance of the original in the count mode during the flow reading mode will be explained. Similar to the flow reading mode (FIGS. 5E and 5F), pursuant to the original $P_n$, the next original $P_{n-1}$ is successively supplied with a predetermined distance between these originals, and the conveyance for the distance adjustment is effected. Since the count mode, wherein the originals are supplied and conveyed with substantially the same original-to-original distance, is advantageous in comparison with the fix reading mode because the waiting time is short, even when the average convey speed in the count mode is slower than that in the sequence mode, the number of originals to be supplied per unit time becomes equal to or greater than that in the sequence mode. In the flow reading mode, the time period for changing from the condition shown in FIG. 5G to the condition shown in FIG. 5H is loss time due to the heading sequence, and, in the sequence mode, the time period for changing from the condition shown in FIG. 9D to the condition shown in FIG. 9E is loss time due to the heading sequence. Incidentally, since the heading speed is limited by the original separating speed, in the illustrated embodiment, the heading speed was selected to 500–600 mm/sec.

According to the illustrated embodiment, also in the flow reading mode, although the original is temporarily stopped for tip end adjustment, such stop time is considerably shorter than the stop time for the distance adjustment in the sequence mode. Incidentally, the reason for differentiating the distance adjustment control in the count mode from that in the sequence mode is that the power consumption and peak current value of the apparatus are decreased (in the sequence mode, since the rising acceleration and top speed of the original are great in comparison with the count mode, the current value flowing through the drive source becomes great) and the operating noise generated by simultaneously driving a plurality of drive systems (although not shown, a drive system for separating the originals differs from drive system(s) for conveying the original to the platen glass) at a high speed is suppressed (in the flow reading mode, since the top speed is small, the synchronous convey control can be effected while suppressing the power consumption, the peak current value and the operating noise).

In the count mode, as well as the flow reading mode and the sequence mode, the reason why the originals are conveyed with the predetermined original-to-original distance is that the conveyance of the original from the original supply to the original discharge is maintained in a certain constant condition, thereby providing stable handling, discharging and re-stacking.

As mentioned above, according to one of features of the automatic original supplying apparatus of the present invention, in the count mode, it is so controlled that the original is conveyed under the flow reading mode. In the flow reading mode, since the originals P are continuously conveyed without stopping the original P at the reading position and without stopping the pulse motor for driving the endless belt 20 to position the belt at the reading position, the noise and vibration generated by counting the number of originals can be minimized. Further, in the illustrated embodiment, the flow reading mode has a plurality of different modes regarding the original convey speed to match the process speed of the associated copying machine, so that, in the count mode, the original can be controlled to convey the original in the high speed flow reading mode. As a result, the number of the originals can be counted at a high speed.

According to another feature of the present invention, the original conveying speed in the fix reading mode is set to become greater than the original conveying speed in the flow reading mode by twice or more. As a result, the original conveying speed in the high speed flow reading mode can be selected to be the maximum speed in the flow reading mode available to the apparatus.

Incidentally, in accordance with the size of the original, the switch-back path shown in FIG. 2 or the closed loop path shown in FIG. 3 is used. For example, the closed loop path is used to treat the original having an A4 size and a B5 size, the switch-back path is used to treat the original having B4 size and A3 size, and the switch-back path is used to treat originals having (the mixture of) A4 size and B5 size. That is to say, normally, although the closed loop path can treat the originals at a faster speed and be applied to only small size original, in the present invention, the closed loop path can be applied to the originals having sizes A4 and B5 (Letter size). The selection of the path is automatically effected. That is to say, when the size of the original on the original stacking plate 5 is detected by the sensor, the ascent/descent drive device G is controlled on the basis of the signal from the sensor. Normally, the apparatus is in the condition shown in FIG. 2, and, when the originals of A4 size are used, the apparatus is shifted to the condition shown in FIG. 3.

Further, in the closed loop path shown in FIG. 3, the flow reading mode is selected when a single copy is obtained from each original, and the fix reading mode is selected when a plurality of copies are obtained from each original. In the flow reading mode, the light source 907 is shifted from the position shown in FIG. 2 to the position shown in FIG. 3 and is then fixed there to hasten the start of the reading. Concretely, the original conveying speed V1 in the flow reading mode is 300–350 mm/sec and the original conveying speed V2 in the fix reading mode is 800–1300 mm/sec. The original conveying speed in the flow reading mode is determined in synchronism with the process speed of the copying machine, and the original conveying speed in the fix reading mode is determined to be faster in accordance with the ability of the original supplying apparatus. Further, in the high speed flow reading, the original is conveyed at a speed of 500–600 mm/sec.

In the closed loop path shown in FIG. 3, the count mode is effected so that all of the originals are conveyed by one circulation without reading the originals, meanwhile, the number of originals is counted by the original pass detection sensor disposed in the convey path. The count mode is used when both-face copies are obtained from a plurality of originals each having a single imaged surface. Further, the count mode is also effected during the original reset operation after jam treatment. In this case, the originals are counted to correct the page order (page sequence) of the original to be the page order before the jam occurs or place the originals in the proper page order. Thus, in this case, the originals are circulated one or more times. Each circulation is detected by the recycle lever 10.

Incidentally, the present invention can also be applied to an original flow reading mode wherein the originals are not stopped but are successively passed through the reading position. Accordingly, also in the count mode, the originals are not temporarily stopped but are continuously conveyed.

What is claimed is:

1. An automatic original supplying apparatus comprising:

original stacking means on which originals can be rested; and original convey means for separating and supplying the originals, one by one, and for conveying the separated original to a reading position, wherein said apparatus operates in a flow reading mode, in which reading means is fixed and the original is shifted with respect to said reading means, a fix reading scan mode in which the original is fixed at a reading position and said reading means is shifted with respect to the fixed original, and a count mode in which a number of originals is counted, and wherein an original conveying speed in said fix reading scan mode is faster than an original conveying speed in said flow reading mode, and, in said count mode, the original is conveyed under the original conveying speed of said flow reading mode.

2. An automatic original supplying apparatus according to claim 1, wherein said flow reading mode has a plurality of modes having different original conveying speeds, and, in said count mode, the original is conveyed under the original conveying speed of a high speed flow reading mode among said plurality of modes.

3. An automatic original supplying apparatus according to claim 1, wherein, in said fix reading scan mode, while a preceding original is being read at said reading position, a succeeding original is waiting at a position spaced apart from said preceding original by a predetermined distance.

4. An automatic original supplying apparatus according to claim 3, wherein said preceding and succeeding originals both rest on a platen.

5. An automatic original supplying apparatus according to claim 1, wherein, in said flow reading mode, the original is temporarily stopped immediately before said reading position.

6. An automatic original supplying apparatus according to claim 5, wherein a succeeding original is also temporarily stopped with a predetermined distance between preceding and succeeding originals.

7. An automatic original supplying apparatus according to claim 1, wherein, when each original is read a number of times, one reading operation is effected under the flow reading mode, and the other reading operations are effected under the fix reading scan mode.

8. An automatic original supplying apparatus according to claim 1, wherein, when each original is read once, a reading operation is effected under the flow reading mode.

9. An automatic original supplying apparatus according to claim 8, wherein the original is temporarily stopped at said reading position for a time period shorter than that in the fix reading scan mode.

10. An automatic original supplying apparatus according to claim 1, further comprising an ascent/descent means for lifting and lowering said original stacking means between a lifted position and a lowered position, wherein said original convey means comprises an endless belt for conveying the original to said reading position on a platen, a switch-back path through which the original is conveyed from said original stacking means to said endless belt and the original conveyed to said reading position by said endless belt is then discharged onto said original stacking means by rotating said endless belt in a reverse direction, and a closed loop path through which the original is conveyed from said original stacking means to said endless belt and the original is then discharged onto said original stacking means via said reading position by rotating said endless belt in one direction, wherein, when said original stacking means is in said lifted position, the original can be supplied from one end of said original stacking means to a supply and separation portion of said switch-back path, and, when said original stacking means is in said lowered position, the original can be supplied from the other end of said original stacking means to a supply and separation portion of said closed loop path, and wherein said original convey means associated with said closed loop path operates in fix reading scan mode, flow reading mode and count mode.

11. An image forming apparatus comprising:

an automatic original supplying apparatus according to any one of claims 1 to 10;

an image forming means for forming an image in response to image information read from the original; and a sheet supply means for supplying a sheet one by one.

12. An automatic original supplying apparatus according to claim 3, wherein, in said flow reading mode, the original is temporarily stopped immediately before said reading position.

13. An automatic original supplying apparatus according to claim 12, wherein a succeeding original is also temporarily stopped with a predetermined distance between preceding and succeeding originals.

14. An automatic original supplying apparatus according to claim 13, wherein, when each original is read a number of times, one reading operation is effected under the flow reading mode, and the other reading operations are effected under the fix reading scan mode.

15. An automatic original supplying apparatus according to claim 14, wherein, when each original is read once, a reading operation is effected under the flow reading mode.

16. An automatic original supplying apparatus according to claim 15, further comprising an ascent/decent means for lifting and lowering said original stacking means between a lifted position and a lowered position, wherein said original convey means comprises an endless belt for conveying the original to said reading position on a platen, a switch-back path through which the original is conveyed from said original stacking means to said endless belt and the original conveyed to said reading position by said endless belt is then discharged onto said original stacking means by rotating said endless belt in a reverse direction, and a closed loop path through which the original is conveyed from said original stacking means to said endless belt and the original is then discharged onto said original stacking means via said reading position by rotating said endless belt in one direction, wherein when said original stacking means is in said lifted position, the original can be supplied from one end of said original stacking means to a supply and separation portion of said switch-back, and, when said original stacking means is in a lowered position, the original can be supplied from the other end of said original stacking means to a supply and separation portion of said closed loop path, and wherein said original convey means associated with said closed loop path operates in fix reading scan mode, flow reading mode and count mode.

17. An automatic original supplying apparatus according to claim 15, wherein the original is temporarily stopped at said reading position for a time period shorter than that in the fix reading scan mode.

* * * * *

UNITED STATES PATENT AND TRADEMARK OFFICE

CERTIFICATE OF CORRECTION

PATENT NO. : 5,812,912

DATED : September 22, 1998

INVENTOR(S) : MASAKAZU HIROI, ET AL.

It is certified that error appears in the above-identified patent and that said Letters Patent is hereby corrected as shown below:

COLUMN 2,
Line 57, "illustration" should read --illustrations--; and
Line 59, "illustration" should read --illustrations--.

COLUMN 4,
Line 28, "roller" should read --roller 19--; and
Line 39, "the both" should read --both--.

COLUMN 9,
Line 27, "contrast" should read --contrast,--; and
Line 38, "mm(sec)." should read --mm/sec)).--.

COLUMN 12,
Line 10, "discharging" should read --discharging,--;
Line 44, "be" should read --can be--; and
Line 45, "original;" should read --originals,--.

COLUMN 13,
Line 6, "originals," should read --originals;--.

UNITED STATES PATENT AND TRADEMARK OFFICE

CERTIFICATE OF CORRECTION

PATENT NO. : 5,812,912

DATED : September 22, 1998

INVENTOR(S) : MASAKAZU HIROI, ET AL.

It is certified that error appears in the above-identified patent and that said Letters Patent is hereby corrected as shown below:

COLUMN 14,
Line 13, "position." should read --position,--.

Signed and Sealed this

Eighth Day of June, 1999

*Attest:*

Q. TODD DICKINSON

*Attesting Officer*

*Acting Commissioner of Patents and Trademarks*